US005978550A

United States Patent [19]

Rochelle

[11] Patent Number: 5,978,550

[45] Date of Patent: Nov. 2, 1999

[54] WATER HEATING ELEMENT WITH ENCAPSULATED BULKHEAD

[75] Inventor: Gary P. Rochelle, Marina del Ray, Calif.

[73] Assignee: Aquatemp Products Corporation, Gardena, Calif.

[21] Appl. No.: 09/021,698

[22] Filed: Feb. 10, 1998

[51] Int. Cl.[6] ..... F24H 9/12; H05B 3/40

[52] U.S. Cl. ..... 392/501; 392/497

[58] Field of Search ..... 392/501, 497, 392/451, 455, 503; 219/523, 551, 541; 123/142.5 E

[56] References Cited

U.S. PATENT DOCUMENTS

| | | | |
|---|---|---|---|
| 3,953,707 | 4/1976 | Tanis | 219/205 |
| 4,208,570 | 6/1980 | Rynard | 219/208 |
| 5,191,634 | 3/1993 | Couch | 392/501 |
| 5,196,673 | 3/1993 | Tanis | 219/205 |
| 5,586,214 | 12/1996 | Eckman | 392/503 |

OTHER PUBLICATIONS

Aquatemp Products Corporation, "A Handy–Dandy Guide to Heaters" (1996).

*Primary Examiner*—Teresa Walberg
*Assistant Examiner*—Vinod D Patel
*Attorney, Agent, or Firm*—Christensen O'Connor Johnson & Kindness PLLC

[57] ABSTRACT

A water heating element (12) has an encapsulated bulkhead flange (16). The water heating element includes a heating coil (32) that is housed in an outer sheath (34). The bulkhead flange is secured onto the outer sheath at a sheath-to-bulkhead braze joint (42). A polymeric bulkhead flange seal (18) encapsulates the bulkhead flange, and extends sufficiently to keep the bulkhead flange and the brazing connection out of contact with water. The polymeric bulkhead flange seal includes a polymeric potting cup (44) that has a top (46), a bottom (48), and a sidewall (50). The bulkhead flange is received within and surrounded by the potting cup. The potting cup is filled with a potting material such that the potting (52) encapsulates the sides and bottom of the bulkhead flange. The potting cup includes standoffs (54) that space apart the bottom of the potting cup from a top (36) of the bulkhead flange, and the potting also covers a majority of the top of the bulkhead flange. The potting cup also includes integral curing sealing ridges (58, 60) to define an integral gasket.

19 Claims, 2 Drawing Sheets

WATER HEATING ELEMENT WITH ENCAPSULATED BULKHEAD

FIELD OF THE INVENTION

The present invention relates to a water heating element and, more particularly, to a water heating element for a heater for spas, hot-tubs, and pools.

BACKGROUND OF THE INVENTION

Electrical resistance heating elements are used to heat water in a wide variety of applications. For example, heating elements are used in water heaters for water systems in commercial and residential buildings, pools and baths, and spas. The water chemistry environment to which heating elements are exposed depends upon the application. Of the applications listed above, spas and hot-tubs perhaps present the harshest environments to water heating elements, because they recirculate water.

As a result, water chemistry must be monitored frequently for sanitary reasons and for corrosion control. Monitored parameters typically include pH, total alkalinity, calcium hardness, and total dissolved solids. For example, pH is desirably maintained around a neutral pH level of 7.0. If any of these parameters is outside a predetermined band of acceptable values, then corrective action should be taken to return water chemistry parameters to values within the predetermined band. Unfortunately, water chemistry may not be monitored sufficiently, or corrective action may not be taken when warranted.

If water chemistry parameters are allowed to remain outside the predetermined band of acceptable values, corrosion of metallic spa and hot tub components can result. Typical corrosion mechanisms include galvanic corrosion, chemical pitting, intergranular corrosion, stress corrosion cracking, corrosion fatigue, electrochemical corrosion, and bacterial corrosion due to Ferrobacillus bacteria. Corrosion of conventional heating elements is an all too frequent cause of spa breakdown.

One component of a spa heating element that is particularly susceptible to corrosion is a bulkhead flange. In a typical heating element known in the prior art, the heating element is contained within a stainless steel heater housing. The heater housing has an aperture for receiving the ends of the heating element therethrough. The heating element is constructed from a heating coil that has two ends, each connected to a cold pin. The heating coil and the cold pins are coaxially housed within a tubular outer sheath of stainless steel filled with a dielectric material. An annular stainless steel bulkhead flange is typically brazed about the outer sheath adjacent each end of the element. A bulkhead gasket is placed between the bulkhead flange and the interior of the housing. A bulkhead nut is then threaded onto each cold pin so the bulkhead flange and the bulkhead nut hold the bulkhead gasket in sealing engagement with the interior of the housing. Thus, the sheath-to-bulkhead flange braze is completely surrounded by water. Further, the bulkhead flange is surrounded by water, except where the bulkhead flange abuts the bulkhead gasket.

As a result, corrosion of the bulkhead flange and the sheath-to-bulkhead flange braze can, and often do, occur when water chemistry parameters are allowed to remain out of the predetermined band of acceptable values. The bulkhead flange is machined and the outer sheath is bent and formed, so the ingredients in their respective stainless steels differ. Accordingly, galvanic corrosion can result from improper control of water chemistry. Further, care must be taken when brazing the outer sheath to the bulkhead flange to ensure no impurities remain in the brazed joint. Braze impurities, along with out-of-specification water chemistry parameters, can result in corrosion at the braze joint.

The corrosion of the bulkhead flange and the sheath-to-bulkhead flange braze joint can range from a rust-like deposit to cracks and fissures in the metal. The corrosion can even lead to corrosion fatigue, causing the bulkhead flange to break away from the outer sheath. If the bulkhead flange breaks away from the outer sheath, the heating element may be damaged beyond repair. In this case, the heating element must be discarded. This type of failure thus represents a costly problem.

Other attempts have been made to address the shortcomings of brazed bulkheads by welding the element to the housing. However, this results in an element that is not replaceable in the field, and weld failure may still occur due to corrosion.

Rather than brazing a bulkhead onto an element sheath, another conventional style is to weld a bulkhead to a sheath, on the upper (threaded) side of the element. A void between the bulkhead and sheath is then sealed. Wile this protects the weld joint, the bulkhead is still wetted and subject to corrosion.

SUMMARY OF THE INVENTION

The present invention provides a water heating element with an encapsulated bulkhead flange. The water heating element includes a heating coil that is housed within an outer sheath. A bulkhead flange is joined onto the outer sheath at a sheath-to-bulkhead flange joint. A polymeric bulkhead flange seal encapsulates the bulkhead flange, thereby keeping the bulkhead flange out of contact with water.

According to one aspect of the present invention, the polymeric bulkhead flange seal includes a polymeric potting cup that has a top, a bottom, and sides. The bottom of the potting cup overlies the bulkhead flange. The potting cup is filled with a high-temperature (e.g., 250° F.) and water resistant polymeric potting material such that the potting material encapsulates the sides and bottom of the bulkhead flange. According to another aspect, the potting cup includes standoffs that space the bottom of the potting cup away from a top surface of the bulkhead flange, and the potting material covers a majority of the top surface of the bulkhead flange. According to another aspect, the potting material substantially fills the potting cup, such that the potting encapsulates the sheath-to-bulkhead flange joint.

According to another aspect of the present invention, the top of the potting cup defines an integral sealing gasket. The sealing gasket is defined in part by one or more raised annular ridges that are arranged in sealing engagement with the housing for the heating element. According to another aspect of the present invention, the raised ridges are radially aligned with the standoffs.

The present invention encapsulates the bulkhead flange and the sheath-to-bulkhead flange brazed joint of a heating element, thus taking these areas out of contact with water. The present invention thus substantially reduces, and nearly eliminates, failures of water heating elements due to corrosion of the bulkhead flange and the sheath-to-bulkhead flange braze joint.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
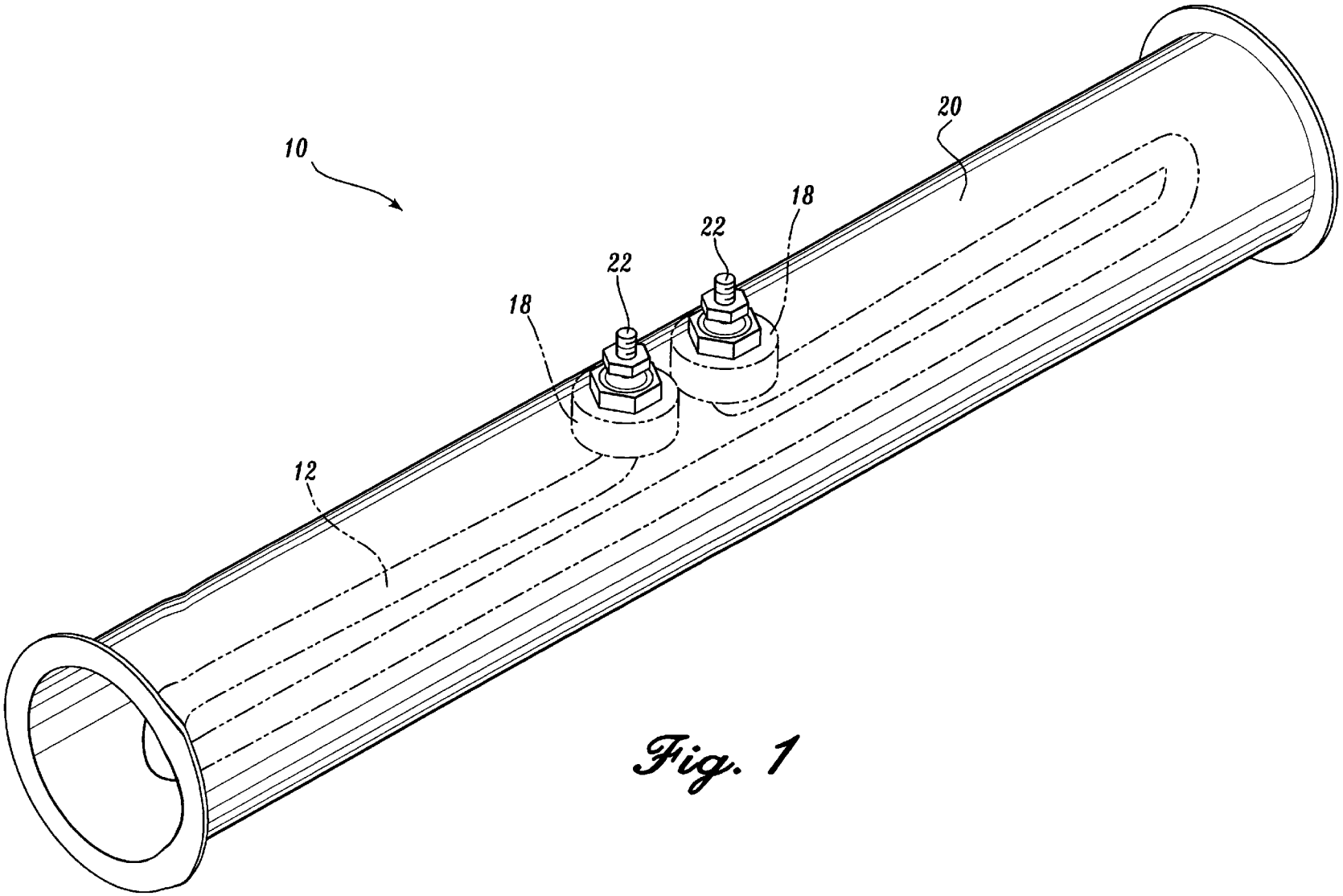
FIG. 1 is a perspective view of a water heater having a water heating element with a bulkhead seal of the present invention.

FIG. 1 shows a water heater 10 that includes a water heating element 12 constructed in accordance with the present invention. As will be discussed in detail below, the water heating element 12 includes a bulkhead flange 16 (FIG. 2) that is encapsulated in a polymeric bulkhead flange seal 18 that includes a polymeric potting cup 44 (FIG. 2) filled with potting 52 (FIG. 2), thus keeping the bulkhead flange 16 out of contact with water.

The water heating element 12 is contained within an elongate tubular heater housing 20. The heater housing 20 is an elongate, hollow cylinder that is made of a corrosion-resistant metal, such as stainless steel. In a preferred embodiment, the water heater 10 is arranged and connected in a piping system to heat a fluid, for example spa water that flows through the housing 20. However, it will be appreciated that the water heater 10 is suitably used in any number of other applications, including, without limitation, a bath, a pool, a hot-tub, or a water heating tank for commercial or residential buildings. It will be appreciated that the examples of applications listed above are given by way of non-limiting example only, and are not intended to limit the scope of the invention.

Figure 2:
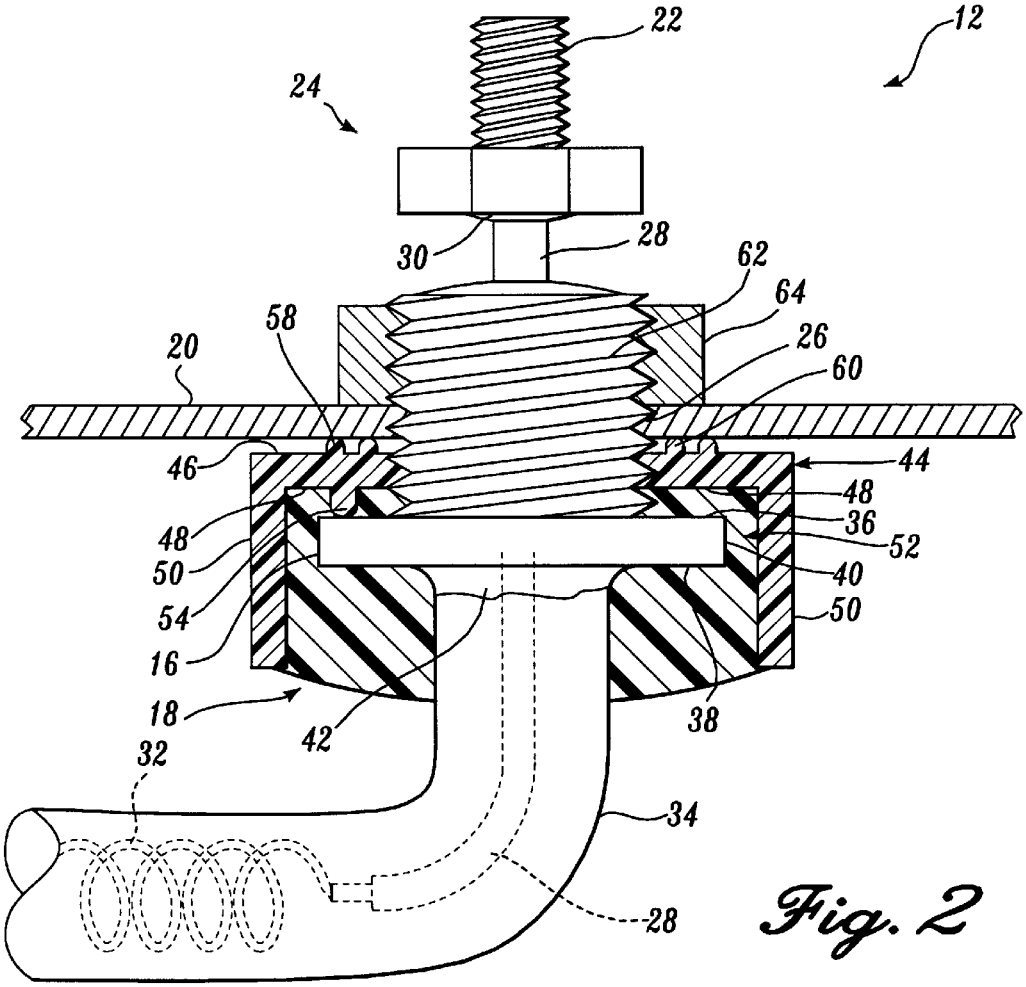
FIG. 2 is a partial axial cross-sectional side view of a water heating element with a bulkhead seal of the present invention.

Referring now to FIGS. 1 and 2, the water heating element 12 includes two electrical terminals 22 that are located at terminal ends 24 of the water heating element 12. The terminal ends 24 extend through openings 26 in the heater housing 20. The electrical terminal 22 is welded in a conventional manner to a cold pin 28 at a terminal-to-cold pin weld 30. The cold pin 28 is connected to a heating coil 32, as is well known, and the heating coil 32 and a majority of the cold pin 28 are surrounded by a dielectric material within an outer sheath 34. Because the outer sheath 34 is bent and formed during fabrication, the outer sheath 34 is preferably made from a ductile stainless steel.

One of the annular bulkhead flanges 16 is secured at each terminal end 24 for mounting the water heating element 12 within the heater housing 20. The bulkhead flange 16 is suitably made of a harder, machinable stainless steel. The bulkhead flange 16 has an annular disk shape, defining a circular top 36, a circular bottom 38, and cylindrical sides 40. The bulkhead flange 16 is joined in a conventional manner to the outer sheath 34 at a joint, such as by a sheath-to-bulkhead flange braze joint 42. As is well known, it is desirable that the brazed joint 42 be substantially free of impurities to reduce the potential for corrosion. Rather than a brazed joint, the use of a welded joint is also within the scope of the present invention.

Figure 3:
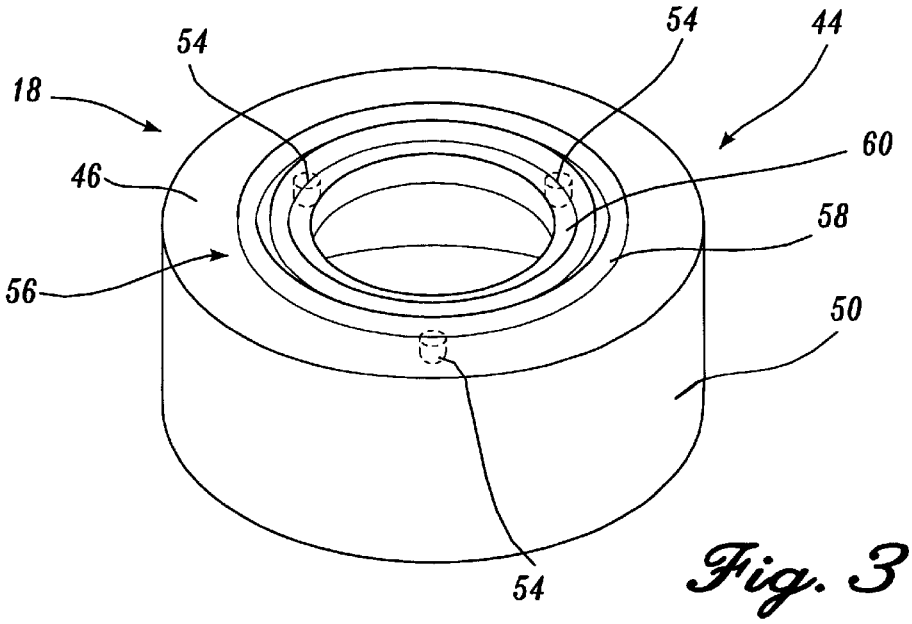
FIG. 3 is a perspective view of a component of a bulkhead seal of the present invention.

Referring now to FIGS. 2 and 3, according to the present invention, the bulkhead flange 16 is encapsulated in the polymeric bulkhead seal 18, thus keeping the bulkhead flange 16 out of contact with water. The polymeric bulkhead seal 18 includes a polymeric potting cup 44 that overlies the bulkhead flange 16. The polymeric potting cup is preferably made of a high temperature thermoplastic or thermosetting material that can withstand the temperature and water chemistry environment of a typical spa. Still more preferably, the potting cup 44 is formed from a thermoplastic elastomer so that it can serve the additional function of providing an integral sealing gasket, as shall be described subsequently. The polymeric potting cup 44 includes an annular base defining an exterior top 46 and an interior bottom 48, and a tubular sidewall projecting downwardly from the perimeter of the base to define an exterior sidewall 50. As used herein, "top" and "bottom" refer to the installed configuration shown in FIG. 2 for convenience. However, it should be understood that the cup 44 is filled in the inverted position, and can be installed and used in any position, i.e., with terminals 22 projecting up, down, or laterally. The top 46 and the bottom 48 of the polymeric potting cup 44 have a diameter that is larger than a diameter of the top 36 and the bottom 38 of the bulkhead flange 16. The interior of the cup 48 defined by the sidewall 50 thus has a larger internal diameter than the outside diameter of the bulkhead flange 16. The potting cup 44 is installed in the inverted position shown in FIG. 2, with the terminal end 22 projecting through a central aperture defined through the base of the potting cup 44. In this installed position, the bottom 48 of the potting cup 44 overlies the top 36 of the bulkhead flange 16. The bottom 48 is spaced apart from the top 36 of the flange 16, as shall be described subsequently. The flange 16 and brazed joint 42 are completely housed within the interior of the potting cup 44. Thus, the sidewall of the potting cup 44 extends past the bottom 38 of the bulkhead flange 16, and past the brazed joint 42.

The potting cup 44 is sealed after installation on the terminal end by turning the heater element upside down from the configuration shown in FIG. 2. Liquid potting 52, such as a mixed, uncured two-part epoxy polymer, is then flowed into the interior of the potting cup 44, such that the potting cup 44 is filled with the potting 52. The potting 52 thus encapsulates the top 36, side 40 and bottom 38 of the bulkhead flange 16, as well as the brazed joint 42, thus sealing the bulkhead flange 16 and brazed joint 42 from contact with water. The epoxy potting 52 is then cured to a hardened state. Other water and temperature resistant potting materials may also be utilized, such as polyurethanes or polysulfides. The cured potting completely covers both the bulkhead and the brazed joint.

In a presently preferred embodiment, the polymeric potting cup 44 includes interior standoffs 54 that project from the bottom 48. A plurality of button shaped standoffs 54 are arranged radially about the central aperture of the base of the potting cup 44. The standoffs 54 act to space apart the bottom 48 of the polymeric potting cup 44 from the top 36 of the bulkhead flange. In this presently preferred embodiment, when the potting 52 is flowed into the polymeric potting cup 44, the potting 52 flows between the potting cup 44 and the top of the flange 16, to cover a majority of the top 36 of the polymeric bulkhead flange 16. The standoffs also ensure that a uniform desired thickness of potting 52 is formed, to ensure adequate sealing while also ensuring that a sufficient length of threads on the terminal end will be exposed after installation for secure mounting. FIG. 3 shows three of the standoffs 54 arranged at 120° radial intervals. However, it will be appreciated that the polymeric potting cup 44 can include any number of the standoffs 54, as desired.

In a presently preferred embodiment, the polymeric potting cup 44 further provides a sealing gasket 56 that is integrated with the polymeric potting cup 44. The gasket 56 is provided for sealing the water heating element 12 within the heater housing 20. The gasket 56 is defined in part by a first raised O-ring ridge 58 that is concentrically located on the top 46 of the polymeric potting cup 44 about the central sealing aperture. The gasket 56 suitably also includes a second raised O-ring ridge 60 that is provided on the top 46 of the polymeric potting cup 44. The second O-ring ridge 60 is also concentric with the first O-ring ridge 58 and the polymeric potting cup 44, and is located interior and spaced radially from the first O-ring ridge 58. The terminal end 24 includes threads 62 onto which a bulkhead nut 64 is threadedly received. Tightening the bulkhead nut 64 onto the threads 62 draws the bulkhead flange 16 toward the heater housing 14. The polymeric potting cup 44 and the gasket 56 are brought into sealing engagement with the heater housing 14, and the gasket 56 is compressed, squeezing the ridges 58 and 60. This prevents water from leaking past the ridges 58 and 60, ensuring there is no leakage between the potting cup 44 and threads 62. This compression also seals the bottom 48 of the potting cup 44 against the upper potted surface of the flange 16.

In the preferred embodiment illustrated, the first O-ring ridge 58 is substantially aligned radially with the interior perimeter of the flange 16. Further, the standoffs 54 are also radially aligned with the gasket 56, underlying the ridges 58 and 60. In this presently preferred embodiment, the radial alignment of the gasket 56 and the standoffs 54, so that the standoffs 54 are sealed against the surrounding potting 52 and the flange 16.

While it is preferred to use the potting cup 44 as an integral gasket, it is within the scope of the present invention to use the potting cup 44 to form the potting, followed by removal of the potting cup and placement of a separate gasket or o-ring type seal therefor.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A bulkhead seal assembly for forming a water tight seal between the end of an electrical heating element and a water-filled housing, the element end passing through a bulkhead aperture defined in the housing, comprising:

an annular bulkhead flange joined about the heating element proximate the element end, the bulkhead flange defining a top, a bottom, and a sidewall; and a polymeric bulkhead seal that encapsulates the top, bottom, and sidewall of the bulkhead flange.

2. The bulkhead seal assembly of claim 1, wherein the polymeric bulkhead seal comprises:

a polymeric potting cup having an annular base that receives the element end to overlie the top of the bulkhead flange, and a tubular sidewall that surrounds the bulkhead flange; and potting that is contained within the polymeric potting cup and that encapsulates at least the sidewall and the bottom of the bulkhead flange.

3. The bulkhead seal assembly of claim 2, wherein the polymeric potting cup includes a standoff that spaces apart the interior bottom of the polymeric potting cup from the top of the bulkhead flange, such that the potting encapsulates a majority of the top of the bulkhead flange.

4. The bulkhead seal assembly of claim 3, further comprising a plurality of standoffs arranged about the interior bottom of the annular base of the polymeric potting cup.

5. The bulkhead seal assembly of claim 3, further comprising a sealing ridge defined on the exterior top of the base of the polymeric potting cup.

6. The bulkhead seal assembly of claim 5, wherein the standoff is radially aligned within the sealing ridge.

7. The bulkhead seal assembly of claim 2, wherein the potting extends to encapsulate a joint between the bulkhead flange and the outer sheath.

8. The bulkhead seal assembly of claim 2, wherein the potting comprises an epoxy.

9. The bulkhead seal assembly of claim 2, wherein the polymeric potting cup has at least a portion of the base formed from an elastomeric material.

10. The bulkhead seal assembly of claim 9, wherein the top of the polymeric potting cup defines an integral gasket.

11. The bulkhead seal assembly of claim 10, wherein the integral gasket comprises a first annular raised ridge.

12. The bulkhead seal assembly of claim 11, wherein the integral gasket further comprises a second annular ridge formed concentric with the first annular ridge.

13. The bulkhead seal assembly of claim 1, wherein the polymeric bulkhead seal includes an integral sealing gasket.

14. A polymeric seal for a bulkhead flange of a water heating element, the water heating element including a heating coil that is housed in an outer sheath, a bulkhead flange that is joined onto the outer sheath at a joint, the bulkhead flange having a top, a bottom, and a sidewall, the polymeric bulkhead seal comprising:

a polymeric potting cup having a top, a bottom, and a sidewall, the bottom of the polymeric potting cup overlying the top of the bulkhead flange and the sidewall of the polymeric potting cup surrounding the sidewall of the flange; and potting that is contained within the polymeric potting cup, the potting encapsulating at least the sidewall and bottom of the bulkhead flange.

15. The polymeric seal of claim 14, wherein the potting also substantially encapsulates the top of the flange.

16. The bulkhead seal of claim 15, wherein the polymeric potting cup includes at least one standoff that spaces apart the bottom of the polymeric potting cup from the top of the bulkhead flange, such that the potting encapsulates a majority of the top of the bulkhead flange.

17. The bulkhead seal of claim 16, wherein the top of the polymeric potting cup defines a gasket.

18. The bulkhead seal of claim 17, wherein the standoffs are radially aligned with the gasket.

19. A method of encapsulating a flanged water heating element in a polymeric bulkhead seal, the water heating element including a heating coil that is housed in an outer sheath and a bulkhead flange that is joined onto the outer sheath at a joint, the flange having a top, a bottom, and sides, the method comprising:

installing a polymeric potting cup about the bulkhead flange; and flowing potting into the polymeric potting cup such that the potting encapsulates the bulkhead flange.

* * * * *